United States Patent [19]

Bauer et al.

[11] 4,300,344

[45] Nov. 17, 1981

[54] FEED YARN AND PROCESS FOR THE MANUFACTURE OF A VOLUMINOUS FALSE TWIST TEXTURIZED HAIRY YARN

[75] Inventors: Günther Bauer, Königsbrunn; Wolfgang Burghardt, Bobingen; Hilmar Möller, Neusäss-Westheim, all of Fed. Rep. of Germany

[73] Assignee: Hoechst Aktiengesellschaft, Fed. Rep. of Germany

[21] Appl. No.: 96,482

[22] Filed: Nov. 21, 1979

[30] Foreign Application Priority Data

Nov. 24, 1978 [DE] Fed. Rep. of Germany ..... 2850854

[51] Int. Cl.[3] ..... D02J 1/00; D02G 3/34

[52] U.S. Cl. ..... 57/288; 57/206; 57/208; 57/2; 57/287

[58] Field of Search ..... 57/2, 3, 6, 206, 208, 57/243, 248, 252, 253, 254, 255, 288, 289, 310, 239, 284, 287, 908

[56] References Cited

U.S. PATENT DOCUMENTS

| | | | |
|---|---|---|---|
| 3,043,088 | 7/1962 | Breen | 57/2 |
| 3,088,188 | 5/1963 | Knudsen | 57/248 X |
| 3,680,301 | 8/1972 | Michel | 57/206 X |
| 3,857,233 | 12/1974 | Cardinal et al. | 57/287 X |
| 3,987,614 | 10/1976 | Cardinal et al. | 57/287 X |
| 4,044,541 | 8/1977 | Ikeda | 57/288 X |
| 4,164,836 | 8/1979 | Tanae et al. | 57/2 |

*Primary Examiner*—Donald Watkins

*Attorney, Agent, or Firm*—Connolly and Hutz

[57] ABSTRACT

Multifilament feed yarns in drawable state made from fiber-forming polyester are provided which in accordance with the invention can be processed in a combined draw and false twist process to voluminous filament yarns having individual protruding filament ends. The feed yarns must consist at least in part of filaments having a flex abrasion resistance of less than 1500 cycles and a crack index of more than 5. By using suitable spin finishes, the crack index can be varied and thus the hairiness of the voluminous filament yarns manufactured can be adjusted independently from the crimp values and the pilling behavior.

7 Claims, 1 Drawing Figure

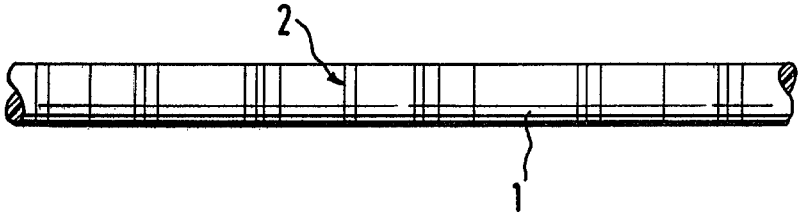
2
1

FEED YARN AND PROCESS FOR THE MANUFACTURE OF A VOLUMINOUS FALSE TWIST TEXTURIZED HAIRY YARN

The present invention provides feed yarns and a process for the manufacture of a voluminous filament yarn having individual protruding ends by false twist texturizing in combination with a drawing process; at least part of the filaments used having a flex abrasion resistance of less than about 1500 cycles.

In German Auslegeschrift No. 23 08 031 (U.S. Pat. Nos. 3,857,233 and 3,987,614), a process is described for the manufacture of a voluminous, false twist texturized filament yarn having individual protruding ends by false twist texturizing of multifilaments or yarns, optionally in combination with a drawing process. According to this Auslegeschrift, at least part of the filaments used must have a flex abrasion resistance of less than about 1500 cycles, because under the conditions of false twist texturization, those filaments having a flex abrasion resistance of less than about 1500 cycles break at irregular intervals due to the transversal stress acting thereon in the texturizing zone. According to this reference, the hairy yarn so obtained may be subjected to subsequent processes for improving the filament bond which provide an at least temporary bonding of the protruding filament ends. In the cited process the flex abrasion resistance value under given texturizing conditions determines the number of protruding filament ends which are formed by the transversal stress in the texturizing zone. On the other hand, the tendency to pilling of the woven and knitted fabrics so obtained is determined by their flex abrasion resistance, too. According to the process of the cited German Auslegeschrift, the choice of the flex abrasion resistance value of the individual filaments or the yarn causes two properties to be inevitably linked one with the other: the number of protruding filament ends, that is, the so-called hairiness, and on the other hand the pilling behavior of the yarn or the textile webs manufactured therefrom. Although the number of protruding filament ends may still be varied by a corresponding choice of the texturizing conditions, these latter ones are however predetermined by the intended crimp of the filament yarn. Because of this inevitable interdependency, it was hitherto impossible to manufacture, for example, a yarn which combines slight hairiness with very good anti-pilling properties. A very reduced tendency to pilling of the textile web requires a low flex abrasion resistance value, which however causes inevitably a great number of protruding filament ends according to the above process of the literature.

According to German Auslegeschrift No. 23 08 031, there was practically one single possible solution for this problem, that is, the use of a feed yarn plyed from two different multifilaments, in which the filaments having a reduced flex abrasion resistance amount to only a fraction of the total feed yarn titer. This operation mode, however, requires much expenditure and is prone to processing troubles.

It is the object of the present invention to provide a process which allows the manufacture of voluminous filament yarns having individual protruding filament ends by false twist texturization in combination with a drawing process, with determination of the hairiness degree, that is, the number of protruding filament ends per unit of length, separately from the crimp properties and the pilling behavior.

In accordance with the invention, there has been surprisingly found that type and composition of the spin finish has a decisive influence on the number of protruding filament ends per unit of length of polyester filaments. It has been observed that some of these finishes cause formation of very hairy filament yarns, wile other finishes under identical texturizing and drawing conditions produce no hairiness at all or to a very small extent only. Although a precise correlation of the degree of hairiness to be expected and the use of finishes of known composition cannot be established as yet, there is provided a simple measuring method allowing to predict the degree of hairiness to be expected. It has been found that only those polyester filaments which have a flex abrasion resistance of less than 1500 cycles and furthermore a crack index of more than 5, preferably more than 10, break at irregular intervals in the texturizing zone under the conditions of false twist texturization. When this crack index of 5 is not attained a crimped filament yarn having no protruding filament ends is obtained on false twist texturizing, while at a crack index of, for example, 100 a very hairy filament yarn is the result. Preferably, the crack index is in the range of from 10 to 100, especially 30 to 80.

The correlation of the crack index with the hairiness of the voluminous filament yarn produced is however valid for those filaments only which have a reduced flex abrasion resistance of less than about 1500 cycles. The relation between flex abrasion resistance and tendency to pilling is described in German Auslegeschrift No. 23 08 031, as well as the preferred ranges of flex abrasion resistance resulting from this relation. In case of the preferred use of undrawn, but preorientated filament yarns, especially from polyesters such a polyethylene terephthalate, it is not necessary that the spinning yarns have the required low flex abrasion resistance of less than 1500 cycles already before the combined drawing and texturizing operations. On the other hand, the required low flex abrasion resistance must be ensured in the moment where the feed yarn arrives at the twister of the false twist equipment. In this case, the flex abrasion resistance is determined on an optimally drawn feed yarn. Filaments having a normal flex abrasion resistance (about 300 to 4000 cycles), however, do not produce hairy yarns on false twist draw texturizing, even at crack indices above 5.

The crack index indicates the number of stress cracks which are observed per unit of filament length of a spinning yarn on cold drawing of undrawn or at least drawable filaments. For test purposes, drawable yarn is placed under the microscope in such a manner that the individual filaments are well visible. One end of this yarn is fixed by clamping, the other free end is passed over a pulley and loaded with a weight in such a manner that the yarn is slowly drawn. During this drawing operation cracks possibly occurring over the circumference of the individual filaments can be well observed. The crack index is determined by letting proceed the drawing operation until a maximum of cracks has formed, stopping it at this moment and counting the number of cracks per unit of length of the filament in this state. The crack index indicates therefore the number of cracks per mm of filament of a spinning yarn on which the maximum number of cracks has been observed. The test has to be repeated several times in order to determine a reliable average value. For demonstration purposes, the accompanying drawing shows a monofilament (1) where a number of stress cracks (2) can be observed.

When the drawing of the monofilaments is continued, the stress cracks disappear, the drawn yarn has no fissured zones any more, and it is practically identical to a yarn treated with another spin finish which does not cause formation of stress cracks.

It has been found that there is a substantial correlation of the crack index with the number of protruding filament ends produced on false twist texturizing per unit of yarn length. It is therefore possible without any difficulty to obtain a defined crack index of drawable filaments by a suitable choice of the spin finish and thus to predetermine the intended hairiness of the voluminous filament yarns. The required flex abrasion resistance data of the filaments are not influenced by the kind of finish and therefore also by the crack index measured.

As results from corresponding tests, the crack index is influenced by a number of factors, for example the spinning, wind up and storage conditions of the spinning material which is not yet drawn but treated with a spin finish. Doubtless, however, the type of finishes used exercises the main influence on the attainable crack index. In order to counterbalance the influence of the storage time on the crack index, the above measurements are taken immediately before processing the filament yarns.

The method for determining the crack index which can be carried out in the simple manner as indicated allows a classification of preparations or finishes with respect to their degree of crack formation on drawable filaments.

Depending on their application, all filaments of the yarn may have the intended high crack index and thus form protruding filament ends, or part of them only may possess this property. Filament yarns consisting of a mixture of filaments having a high crack index and those having a low crack index in a ratio of from 7:3 to 3:7 yield knitted and woven fabrics having an especially attractive appearance and very good general textile properties.

According to an especially preferred embodiment of the process of the invention, one single polyester raw material which due to its structure gives yarns of low flex abrasion resistance is spun through nozzles having at least two different hole sizes. Thus, spinning yarns are produced the titer of which differs by the 2- to 4-fold. When such multifilament yarns are treated with a spin finish yielding high crack indices, feed yarns are obtained which are distinguished by their bulk, their hairiness and especially their textile properties. It has been observed that under these conditions feed yarns are obtained which in the subsequent draw texturization are processed to voluminous hairy yarns, the low-denier filaments of which only break at irregular intervals in the texturizing zone, while the filaments of larger titer ensure sufficient yarn strength and stiffness of the textile webs manufactured therefrom.

A further preferred embodiment of the process of the invention is the following: after having left the nozzle and attained a certain solidification, multifilament yarns are divided into strands which are treated with different spin finishes. After this treatment, the strands are plyed to form again the multifilament yarn, which is then wound up on a bobbin or the like. This process embodiment can be applied to multifilament yarns of identical or different individual titer, and after draw texturization, bulked yarns are obtained in which part of the filaments is broken, while on the other part protruding filament ends are formed at irregular intervals. This process embodiment has the advantage of a considerably simpler operation than separate spinning, possibly with the use of double extruders, and subsequent plying of the required feed yarn.

The polyester raw materials suitable for the manufacture of the feed yarns of the invention or yarn components having a reduced flex abrasion resistance are known. They are for example obtained according to German Auslegeschrift Nos. 17 20 647 and 15 20 984 by addition of modification agents to the polycondensation reaction. Suitable modification agents are for example: silane-ethane-phosphonic acid ester or glycerol, pentaerythritol or trimellitic acid.

The following Examples demonstrate the relation in accordance with the invention between the crack index of the drawable feed yarn and the number of protruding filament ends of the draw texturized yarn manufactured therefrom. The crack index is determined in these examples by the type of finish with which the polyethylene terephthalate feed yarns being in a drawable state have been treated. The number of protruding filament ends, as well as the crimp properties of the texturized yarn, are influenced by the conditions of drawing, that is, the simple correlation of crack index and hairiness is possible only in the case of the other parameters remaining unchanged.

Unless otherwise described in the Examples, the textile data such as flex abrasion resistance, pilling behavior etc., are determined according to the methods described in German Auslegeschrift No. 23 08 031.

EXAMPLE 1

A feed yarn in accordance with the invention was manufactured by doubling 2 yarn components. One of the components of the feed yarn consisted of polyethylene terephthalate filaments having a titer dtex 91f8, which was obtained at a winding rate of 2000 m/min. The raw material consisted of polyethylene terephthalate having a relative viscosity of 1.80, measured at 25° C. on a solution of 1 g in 100 ml of a mixture of phenol/-tetrachloroethane (weight ratio 3:2). Before wind-up, the filaments were treated with a 18% aqueous emulsion of a finish P. The layer of finish, measured as methanol extract, was 0.6% on the average. The aqueous emulsion had a refractive index $n_D^{20}$ of 1.3592.

Composition of the finish P.

45 parts by weight of paraffin oil 200 mPa.s/20° C.
20 parts by weight of stearyl alcohol . 8 EO (ethylene oxide units)
20 parts by weight of coconut fatty alcohol . 5 EO
15 parts by weight of isotridecyl alcohol . 8 EO.

The other component of the feed yarn had an as spin titer of dtex 91f24 and was obtained at a winding rate of 1900 m/min. The raw material of the filaments was obtained according to Example 1 of German Auslegeschrift No. 1 720 647 (however, 2.4 g of zinc acetate having been replaced by 3.1 g of manganese acetate, and the amount of trimethoxysilane-ethane-phosphonic acid diethyl ester having been increased from 48 to 72 g). The relative viscosity of this polymer was $\eta_{rel}=1.59$. Before take-up, the spinning filaments were also treated with an aqueous emulsion of Finishes that is, either with a 18% emulsion of finish P, or a 15% solution of a finish A (refractive index $n_D^{20}=1.3535$), or a 12% aqueous emulsion of a Finish F (refractive index $n_D^{20}=1.3495$).

Finishes A and F werde composed as follows:

Finish A 95 parts by weight of a pentaerythritol-ethoxylate-propylate (4:1)

5 parts by weight of potassium dilauryl phosphate

Finish F 47 parts by weight of trimethylolpropane trilaurate 26 parts by weight of polyoxyethylene-sorbitol hexaoleate 20 parts by weight of ethylene oxide/propylene oxide copolymer, molecular weight about 3000

20 parts by weight of n-nonylphenol . 10 EO 5 parts by weight of oleic acid 2 parts by weight of potassium hydroxide.

For the individual components of the finish, there were used commercial products of usual purity.

The individual filaments of the feed yarn were tested with respect to stress cracks according to the aforementioned measuring method. The results obtained are listed in Table 1, which Table contains also the tests results with respect to flex abrasion resistance, which results were obtained on individual filaments of the drawn but not texturized feed yarns. The drawing ratio was 1:2.2.

The feed yarns provided with their different finishes were drawn and texturized on a false twist texturizing machine by means of a sapphire spindle. The drawing ratio was 1:2.49 at a heater temperature of 185° C. The false twist applied was 3036 turns/m.

The hairiness of the voluminous filament yarns so obtained was tested by means of a Shirley Yarn Hairiness Meter of Messrs. Shirley Development Ltd., England. Using this device, filament ends protruding for more than 2 mm from the yarn were optically stated and recorded. By hairiness, there is to be understood in this context the number of filament ends so counted per 100 m of yarn. The method for measuring the flex abrasion resistance and their relation to the tendency of pilling is described in German Auslegeschrift No. 23 08 031.

TABLE 1

| Spin titer | Finish | Flex abrasion resistance | crack index | Hairiness |
|---|---|---|---|---|
| dtex 91 f 8 | P | low pilling 3550 | 41 | 0 |
| dtex 91 f 24 | P | low pilling 1350 | 77 | 28 |
| dtex 91 f 24 | F | low pilling 1350 | 9 | 6 |
| dtex 91 f 24 | A | low pilling 1310 | 0 | 0 |

All measurements were taken immediately before draw texturization. Repeated tests after a storage time of up to 26 days showed slightly increased crack indices and a corresponding slightly increased hairiness on the filaments treated with the finishes F and P. The flex abrasion resistance is practically influenced neither by the kind of preparation nor the storage time.

EXAMPLE 2

By doubling 2 filaments of polyethylene terephthalate, feed yarns for false twist draw texturization were manufactured. One of the filament components (spinning titer dtex 153f16) was obtained from polyethylene terephthalate having a relative viscosity of 1.80 according to Example 1 and provided with spin finish P. The wind-up rate was 2500 m/min. The second component having a as spun titer dtex 153f32 was obtained from a polyethylene terephthalate modified with 0.3 weight % of trimethylolpropane and having a relative viscosity $\eta rel = 1.57$. Before take-up at a rate of 1600 m/min., this filament component was treated in usual manner with aqueous emulsions of the finishes A and P, respectively. The components doubled before draw texturization gave feed yarns which were simultaneously drawn and false twist texturized on a draw texturizing machine type FK 5 of Barmag Barmer Maschinenfabrik AG, Wuppertal, West-Germany.

The following flex abrasion values were obtained on samples of the filament components:

| | | | |
|---|---|---|---|
| Spin titer | dtex 153 f 16 | | 3464 cycles |
| Spin titer | dtex 153 f 32 | (modified) | 438 cycles |

The undrawn filaments which however were provided with a Finish had the following crack indices:

| Spin titer | Finish | crack index |
|---|---|---|
| dtex 153 f 16 | P | 39 |
| dtex 153 f 32 | P | 67 |
| dtex 153 f 16 | A | 0 |
| dtex 153 f 32 | A | 1 |

When a feed yarn consisting of the components unmodified dtex 153f16, provided with Finish P, and modified dtex 153f32, provided with Finish P was fed to the draw texturizing machine, a voluminous bulked yarn was obtained at a heater temperature of 185° C., a drawing ratio of 1:2.0 and a flase twist of 2653 turns/m, which yarn had a hairiness of 24 hairs/100 m, measured on the Shirley Yarn Hairiness Meter.

When however a feed yarn was used the components of which were provided with Finish A, only bulked yarns without any hairiness were obtained at a false twist of even 3036 turn/m, a drawing ratio of from 1:2.146 to 1.:2.45 and a heater temperature of from 185° to 245° C.

Example 3

The feed yarn in accordance with the invention having spin titer of dtex 300f64 consisted of a polyethylene terephthalate modified with 0.5 weight % of trimethylolpropane having a relative viscosity of 1.57. The filaments obtained were provided in usual manner before wind-up with aqueous emulsions of the finishes A, F or P, the preparation layer was 0.75% in each case, the take-off rate was 1500 m/min. The following crack indices were measured on the filaments obtained:

| Finish | Crack index |
|---|---|
| A | 0 |
| F | 14 |
| P | 72 |

Filaments which were drawn at a ratio of 1:2.2 had a flex abrasion resistance of about 450 cycles.

On draw texturizing of the feed yarns provided with different Finishes by means of a false twist spindle, the filament material was drawn in each case at a ratio of 1:2.20, and the applied false twist was of 2813 turns/m.

The different processing conditions and the properties of the hairy yarns so manufactured are listed in the following Table.

| Finish | Texturizing temperature °C. | Final titer dtex | Hairiness No./100 m |
|---|---|---|---|
| A | 190 | 139 | 2 |
| F | 190 | 139 | 42 |
| P | 190 | 139 | 174 |
| A | 210 | 138 | 4 |
| F | 210 | 138 | 89 |
| P | 210 | failure, heater temperature too high | |

Similar yarns as described in the first part of this Example were subjected to a draw texturization in which a 3-axle friction twister, consisting of 12 disks having a ceramic surface of the roughness degree 50 (Feldmühle AG) produces the false twist. The feed yarns were drawn in this case at a ratio of 1:2.54.

| Finish | Texturizing temperature °C. | Final titer dtex | Hairiness No. 100 m | Crimp $K_1$ % |
|---|---|---|---|---|
| A | 195 | 123 | 2 | 14 |
| F | 195 | 123 | 393 | 14 |
| P | 195 | 123 | 639 | 12 |

The crimp was determined according to the specifications in German Offenlegungsschrift No. 22 11 843, p. 12.

What is claimed is:

1. A feed yarn for the manufacture of a synthetic voluminous filament yarn having individual protruding filament ends by means of drawing and false twist texturizing equipment, comprising undrawn, preferably however preorientated filaments of fiber-forming polyester, part of said filaments at least have a flex abrasion resistance of less than 1500 cycles, and at least part of the filaments having a flex abrasion resistance of less than 1500 cycles having a crack index of more than 5.

2. The feed yarn as claimed in claim 1, wherein all filaments of the feed yarn have a flex abrasion resistance of less than 1500 cycles, but only part of them, preferably from 30 to 70% of the totality of filaments have a crack index of more than 5.

3. The feed yarn is claimed in claim 1, wherein the feed yarn consists of at least two different filament groups differing in their individual titer, the filaments having the coarser titer having individual titers amounting to the 1.5 to 4.0-fold of the individual titer of the finer filaments, and the portion of the coarser filaments being from 20 to 80% of the total number of filaments.

4. The feed yarn as claimed in claim 3, wherein the filaments having the finer individual titer only have a crack index of more than 5.

5. A process for the manufacture of a voluminous filament yarn having individual protruding filament ends comprising the drawing and false twist texturizing of a drawable polyester feed yarn in which feed yarn part at least of the filaments have a flex abrasion resistance of less than 1500 cycles, wherein at least part of the filaments of the yarn, due to the use of a special finish, have a crack index of more than 5.

6. The process as claimed in claim 5, wherein a multifilament yarn is spun through a nozzle having different hole sizes, the different hole size being chosen in such a manner that the titer of the coarser filaments amounts to about the 1.5- to 3-fold of the titer of the finer monofilaments.

7. The process as claimed in claims 5 or 6, wherein a multifilament yarn is divided after spinning through a nozzle and subsequent solidification but before a first wind-up into at least two strands and at least one strand is treated with a special finish which imparts to the treated filaments a crack index of more than 5.

* * * * *